US009760033B2

(12) United States Patent
Onishi et al.

(10) Patent No.: US 9,760,033 B2
(45) Date of Patent: Sep. 12, 2017

(54) TONER FOR DEVELOPING ELECTROSTATIC IMAGES AND METHOD OF PRODUCING TONER

(71) Applicant: Konica Minolta, Inc., Tokyo (JP)

(72) Inventors: Junya Onishi, Hachioji (JP); Shiro Hirano, Hachioji (JP); Aya Shirai, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/213,543

(22) Filed: Jul. 19, 2016

(65) Prior Publication Data

US 2017/0038697 A1 Feb. 9, 2017

(30) Foreign Application Priority Data

Aug. 7, 2015 (JP) ..... 2015-156641

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/08711* (2013.01); *G03G 9/08791* (2013.01); *G03G 9/08795* (2013.01); *G03G 9/08797* (2013.01)

(58) Field of Classification Search
CPC ..... G03G 9/08755; G03G 9/08786; G03G 9/08788; G03G 9/08711
See application file for complete search history.

(56) References Cited

U.S. PATENT DOCUMENTS

2013/0330667 A1* 12/2013 Fukuri ..... G03G 9/09392 430/110.2

FOREIGN PATENT DOCUMENTS

| | | | |
|---|---|---|---|
| JP | 2001222138 | A | 8/2001 |
| JP | 2014-035506 | A | 2/2014 |
| JP | 2014035506 | A | 2/2014 |
| JP | 2015-045850 | A | 3/2015 |

OTHER PUBLICATIONS

Notification of Reasons for Refusal dated Jun. 27, 2017 from corresponding Japanese Patent Application No. JP 2015-156641 and English translation; Total of 11 pages.

* cited by examiner

*Primary Examiner* — Peter Vajda
(74) *Attorney, Agent, or Firm* — Lucas & Mercanti, LLP

(57) ABSTRACT

Provided is a toner for developing electrostatic images containing toner particles. The toner particles contain a crystalline resin and an amorphous resin. The amorphous resin contains an amorphous vinyl resin component containing a polymer of monomers having a structure represented by formula (1). The content of a structural unit derived from the monomers in the toner particles is within a range of 2.4 to 13.5 mass %.

$$H_2C{=}CR_1{-}COOR_2 \quad (1)$$

In formula (1), $R_1$ represents a hydrogen atom or a methyl group and $R_2$ represents a branched alkyl group having a carbon number of 8 or more.

13 Claims, No Drawings

TONER FOR DEVELOPING ELECTROSTATIC IMAGES AND METHOD OF PRODUCING TONER

This application is based on Japanese Patent Application No. 2015-156641 filed on Aug. 7, 2015 with Japan Patent Office, the entire content of which is hereby incorporated by reference.

FIELD OF THE INVENTION

The present invention relates to a toner for developing electrostatic images and a method of producing the toner, in particular, to a toner having satisfactory fixing properties for developing an electrostatic image and a method of producing the toner.

DESCRIPTION OF THE RELATED ART

Toners for developing electrostatic images (hereinafter also simply referred to as "toner") in electrophotographic image forming devices have been developed to achieve high-speed, energy-saving image formation and fixing at low temperatures.

Toners containing a binder resin composed of a mixture of crystalline and amorphous resin components have been known for enhancement of fixing properties at low temperatures (for example, refer to Japanese Unexamined Patent Application Publication No. 2001-222138). Crystalline resin component, which has superior thermal responsiveness compared to amorphous resin component, maintain sufficient strength up to predetermined temperature and undergo a sudden decrease in viscosity once it starts melting at the predetermined temperature. Crystalline resins having such thermal characteristics can achieve superior fixing properties at low temperatures while keeping practical fluidity and strength of the toner.

Significantly high compatibility of a crystalline resin component and an amorphous resin component promotes crystallization of the binder resin. In contrast, significantly low compatibility cannot achieve sufficient fixing properties of the toner at low temperatures, causing a free crystalline resin component to be exposed at the surface of the toner particles. This causes low density and fogging of the images.

Another toner containing a binder resin composed of a crystalline resin component and an amorphous resin component has been proposed, the amorphous resin component having a structure having high affinity for the crystalline resin component, to prevent crystallization of the binder resin and separation of the crystalline resin component and achieve a highly dispersed state of the crystalline resin component in the toner particles (for example, refer to Japanese Unexamined Patent Application Publication No. 2014-35506).

Crystalline resins that can impart enhanced fixing properties at low temperatures to toners are known to readily crystallize during long-term storage below the melting point or under a high-temperature environment. High crystallization causes insufficient melting of the toner particles during fixing, thereby causing impairment of the fixing properties of the toner. This results in under-offset indicating separation of the toner from the sheet. Research and development have been conducted for achieving stable fixing properties of a toner through effective prevention of crystallization during long-term storage and under a high-temperature environment.

BRIEF SUMMARY OF THE INVENTION

An object of the present invention, which has been conceived in light of the problems and circumstances described above, is to provide a toner having satisfactory fixing properties for developing electrostatic images and a method of producing the toner.

The present invention has been attained in consideration of the circumstances described above. It has been found that stable fixing properties of a toner through effective prevention of crystallization during storage under a high-temperature environment can be achieved by the toner of the present invention, which contains an amorphous vinyl resin component containing a predetermined range of structural unit having high affinity for the crystalline resin component.

The above-described object of the present invention can be solved by the following embodiments.

In order to achieve at least one of the above-described objects, according to an first aspect of the present invention, there is provided a toner for developing electrostatic images containing toner particles, wherein the toner particles contain a crystalline resin and an amorphous resin;

the amorphous resin contains an amorphous vinyl resin component containing a polymer of monomers having a structure represented by formula (1); and the content of a structural unit derived from the monomers in the toner particles is within a range of 2.4 to 13.5 mass %:

$$H_2C{=}CR_1{-}COOR_2 \quad (1)$$

where $R_1$ represents a hydrogen atom or a methyl group and $R_2$ represents a branched alkyl group having a carbon number of 8 or more.

Preferably, the content of the structural unit derived from the monomers in the toner particles is within a range of 4.0 to 13.5 mass %.

Preferably, the content of the structural unit derived from the monomers in the toner particles is within a range of 4.9 to 13.5 mass %.

Preferably, the carbon number of the branched alkyl group represented by $R_2$ in formula (1) is 22 or less.

Preferably, the carbon number of the branched alkyl group represented by $R_2$ in formula (1) is 8.

Preferably, the content of the crystalline resin in the toner particles is within a range of 1 to 20 mass %.

Preferably, the crystalline resin contains a crystalline polyester resin component.

Preferably, the amorphous resin further contains an amorphous polyester resin component.

Preferably, the amorphous polyester resin component contains a hybrid resin modified with a styrene acrylic resin component.

Preferably, the content of segments of the styrene acrylic resin component in the hybrid resin is within a range of 1 to 30 mass %.

Preferably, the toner particle contains a silica particle, and the average primary particle diameter of the silica particles is within a range of 70 to 200 nm.

According to a second aspect of a preferred embodiment of the present invention, there is provided a method of producing the toner for developing electrostatic images according to the first aspect, containing:

mixing a dispersion of the crystalline resin in an aqueous medium and a dispersion of the amorphous resin in an aqueous medium with a dispersion of a colorant in an aqueous medium; and agglomerating and fusing the crystalline resin particles, the amorphous resin particles, and the colorant particles in the mixed aqueous media, to produce toner particles.

DETAILED DESCRIPTION OF THE INVENTION

The toner for developing electrostatic images according to the present invention contains a toner particle, the toner particle containing a crystalline resin component and an amorphous resin component, the amorphous resin component containing an amorphous vinyl resin being a polymer of monomers having a structure represented by formula (1) and having a content of structural units derived from the monomers within the range of 2.4 to 13.5 mass % in the toner particle.

These technical characteristics are common in the embodiments of the present invention.

The solutions described above of the present invention provide a toner having satisfactory fixing properties for developing electrostatic images and a method of producing the toner.

The mechanisms and operations that establish the advantages of the present invention are not clarified but are inferred as described below.

The amorphous vinyl resin being a polymer of monomers having a structure represented by formula (1) includes repeated structural units having alkyl groups, which are represented by $R_2$ in formula (1). The alkyl group represented by $R_2$ is a long chain having a carbon number of 8 or more and has high affinity for a crystalline resin having a long and linear chain. It is presumed that the molecular chains of the amorphous vinyl resin having alkyl groups having high affinity for a crystalline resin intrude between molecular chains of the crystalline resin in the toner particles before fixing and uniformly disperse the domains of the crystalline resin, to prevent crystallization. The content of structural units having alkyl groups represented by $R_2$ in the toner particles is within a predetermined range, and chains having high affinity for the crystalline resin is limited. Thus, it is presumed that crystallization originating from such chains can be prevented.

It is presumed that the alkyl groups represented by $R_2$ have a branch structure that inhibit the regular arrangement of molecular chains of the crystalline resin, to effectively prevent crystallization.

A toner that contains an amorphous vinyl resin component that uniformly disperses the crystalline resin component and inhibits the regular arrangement of the crystalline resin component effectively prevents the crystallization of the crystalline resin component during long-term storage and under a high-temperature environment. Thus, it is presumed that the toner particles sufficiently melt during fixing and keep satisfactory fixing properties.

According to an embodiment of the present invention, the content of structural units derived from the monomers in the toner particles is preferably within the range of 4.0 to 13.5 mass %, more preferably 4.9 to 13.5 mass %, to effectively prevent the crystallization of the crystalline resin.

From a similar view point, the carbon number of the branched alkyl groups represented by $R_2$ in formula (1) is preferably 22 or smaller, more preferably 8.

The content of the crystalline resin component in the toner particles is preferably within the range of 1 to 20 mass %, to enhance the fixing properties of the toner at low temperatures.

Through the method of producing toner for developing electrostatic images according to the present invention, the toner for developing electrostatic images can be readily produced through mixing a dispersion of the crystalline resin particles in an aqueous medium, a dispersion of amorphous resin particles in an aqueous medium, and a dispersion of colorant particles in an aqueous medium, and agglomerating and fusing the crystalline resin particles, the amorphous resin particles, and the colorant particles in the mixed aqueous media into toner particles.

Components and embodiments of the present invention will now be described in detail.

Throughout the specification, the term to indicating the numerical range is meant to be inclusive of the boundary values.

[Toner for Developing Electrostatic Images]

The toner for developing electrostatic images according to the present invention contains toner particles. The toner particles contain a binder resin containing a crystalline resin component, an amorphous resin component, and a colorant.

(Amorphous Resin)

The amorphous resin component has a glass-transition temperature (Tg) on an endothermic curve obtained through differential scanning calorimetry (DSC) but lacks a melting point or a clear endothermic peak during a temperature rise. A clear endothermic peak in an endothermic curve has a half width of 15° C. or less at a heating rate of 10° C./min.

The amorphous resin component according to the present invention contains an amorphous vinyl resin being a polymer of monomers having a structure represented by formula (1) and having a content of structural units derived from the monomers in the toner particles within the range of 2.4 to 13.5 mass %.

$$H_2C{=}CR_1{-}COOR_2 \qquad \text{Formula (1)}$$

where $R_1$ represents a hydrogen atom or a methyl group and $R_2$ represents a branched alkyl group having a carbon number of 8 or more.

The amorphous vinyl resin being a polymer of monomers having a structure represented by formula (1) includes repeated structural units having alkyl groups, which are represented by $R_2$ in formula (1). The alkyl group represented by $R_2$ is a long chain having a carbon number of 8 or more and has high affinity for crystalline resin having long and linear chains. It is presumed that the chains of the amorphous vinyl resin having alkyl groups having high affinity for crystalline resin intrude between molecular chains of the crystalline resin component in the toner particles before fixing and uniformly disperse the domains of the crystalline resin component, to prevent crystallization. The plasticization of the binder resin is promoted during melting at the origin or chain of the amorphous vinyl resin intruding between the molecular chains of the crystalline resin component. Such uniform and ready plasticization achieves superior fixing properties of the toner at low temperatures.

The chains of the amorphous vinyl resin having high affinity for the crystalline resin may be arranged regularly like the molecular chains of the crystalline resin. The content of the alkyl groups represented by $R_2$ in the toner particles is within a specific range of 2.4 to 13.5 mass %, limiting the chains having high affinity for the crystalline resin. Thus, crystallization originating from these chains can be prevented.

It is presumed that the branched structure of the alkyl groups in the repeated structural units of the amorphous vinyl resin appropriately inhibits the regular arrangement of the molecular chains of the crystalline resin component, to effectively prevent crystallization.

A toner containing the amorphous vinyl resin that uniformly disperses the crystalline resin component and inhibits the regular arrangement of the crystalline resin component can effectively prevent crystallization of the crystalline resin component during long-term storage and under a high-temperature environment, and the toner particles can sufficiently melt during fixing of the toner. Thus, the toner maintains satisfactory fixing properties.

In view of prevention of further crystallization of crystalline resin, the content of structural units derived from monomers having a structure represented by formula (1) in the toner particles is preferably within the range of 4.0 to 13.5 mass %, more preferably 4.9 to 13.5 mass %.

The content of structural units derived from monomers having a structure represented by formula (1) in the toner particles can be measured through gas chromatography/mass spectrometry (GC/MS), for example.

Specifically, the content can be determined by the standard addition technique with columns and detectors that can detect the monomers having a structure represented by formula (1). Details of typical conditions of pyrolysis and GC/MS analysis are described below.

(Conditions of Pyrolysis)

Device: PY-2020iD (Manufactured by Frontier Laboratories Ltd.)

Mass of sample: 0.1 mg

Heating temperature: 550° C.

Heating time: 0.5 minutes (Run Conditions of GC/MS)

Device: QP2010 (manufactured by Shimadzu Corporation)

Column: Ultra ALLOY-5 (inner circumference 0.25 mm; length 30 m; thickness 0.25 μm; manufactured by Frontier Laboratories Ltd.)

Heating range: 40° C. to 320° C. (maintained at 320° C.)

Heating rate: 20° C./min

In view of effective prevention of crystallization originating from chains of amorphous vinyl resin having high affinity for crystalline resin, the carbon number of branched alkyl groups represented by $R_2$ in formula (1) is preferably 22 or less.

In view of compatibility between uniform dispersion of the crystalline resin component and prevention crystallization originating from chains of amorphous vinyl resin having high affinity for the crystalline resin component, the carbon number of the branched alkyl groups represented by $R_2$ in formula (1) is preferably 8.

Examples of monomers having a structure represented by formula (1) include alkyl (meta)acrylate esters, such as 2-ethylhexyl acrylate, 2-ethylhexyl methacrylate, 1-methylheptyl acrylate, 2-propylheptyl acrylate, 6-methylheptyl acrylate, isooctyl acrylate, isononyl acrylate, isodecyl acrylate, tridecyl acrylate, tridecyl methacrylate, and isostearyl acrylate.

The weight average molecular weight (Mw) of the amorphous vinyl resin is preferably within the range of 20,000 to 150,000, and the number average molecular weight (Mn) preferably within the range of 5,000 to 20,000, in view of compatibility between satisfactory fixing properties and resistance to hot-offset of the toner.

The weight average molecular weight (Mw) and the number average molecular weight (Mn) can be determined from a molecular weight distribution measured through gel permeation chromatography (GPC) as described below.

A sample of a resin component is added to tetrahydrofuran (THF) into a concentration of 1 mg/mL and is dispersed with an ultrasonic disperser for five minutes at room temperature. The mixture is treated with a membrane filter having a pore size of 0.2 μm to prepare a solution. Tetrahydrofuran, which is the carrier solvent, is circulated at a flow rate of 0.2 mL/min through a GPC device HLC-8120GPC (manufactured by Tosoh Corporation), a TSK guard column, and three columns of TSK gel Super HZ-m (manufactured by Tosoh Corporation) at a constant column temperature of 40° C. The carrier solvent and 10 μL of the prepared solution are injected to the GPC device. The solution is detected with a refractive-index (RI) detector, and the molecular weight distribution of the solution is calculated on the basis of a calibration curve prepared through measurement of monodisperse polystyrene standard materials. Ten samples of polystyrene are used for measurement of the calibration curve.

In view of compatibility between sufficient fixing properties of the toner and heat resistance of the toner during storage, the glass-transition temperature (Tg) of the amorphous vinyl resin is preferably within the range of 20° C. to 70° C.

The glass-transition temperature (Tg) can be measured through a method (differential scanning calorimetry (DSC)) in accordance with American Society of the International Association for Testing and Materials (ASTM) Standard D3418-82. The glass-transition temperature (Tg) can be measured with a differential scanning calorimeter DSC-7 (manufactured by PerkinElmer Co., Ltd.) and a thermal analyzer controller TAC7/DX (manufactured by PerkinElmer Co., Ltd.).

The amorphous vinyl resin component may be a homopolymer of a monomer having a structure represented by formula (1) or may be a copolymer of a monomer having a structure represented by formula (1) and another monomer. Examples of the other monomer include styrene, styrenic monomers having a styrene structure, such as a styrene derivative, (meth)acrylic acid, (meth)acrylic acid monomers having (meth)acryl groups, such as n-butyl acrylate.

(Amorphous Polyester Resin)

The amorphous resin component according to the present invention may further contain an amorphous polyester resin, in view of the satisfactory fixing properties of the toner.

The amorphous polyester resin is produced through polycondensation of carboxylic acid having a valency of two or more (polyvalent carboxylic acid) and alcohol having two or more hydroxy groups (polyhydric alcohol).

For toner particles having a core-shell structure, the shell layer may be composed of the amorphous polyester resin.

Polyvalent carboxylic acid is a compound having two or more carboxy groups per molecule.

Specific examples of the polyvalent carboxylic acid include saturated aliphatic dicarboxylic acid, such as oxalic acid, malonic acid, succinic acid, adipic acid, sebacic acid, azelaic acid, n-dodecyl succinic acid, and fumaric acid; cycloaliphatic dicarboxylic acid, such as cyclohexanedicarboxylic acid; aromatic dicarboxylic acid, such as phthalic acid, isophthalic acid, and terephthalic acid; polyvalent carboxylic acid having three or more carboxy groups, such as trimellitic acid and pyromellitic acid; anhydrides of these carboxylic acids; and alkyl esters having a carbon number of 1 to 3. These compounds may be used alone or in combination.

Polyhydric alcohol is a compound having two or more hydroxy groups per molecule.

Specific examples of polyhydric alcohol include aliphatic diols, such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butanediol; ethylene oxide adducts (BPA-EO) of bisphenol A and propylene oxide adducts (BPA-PO) of bisphenol A; and alcohols having three or more hydroxy groups, such as glycerol, pentaerythritol, trimethylolpropane, and sorbitol. These compounds may be used alone or in combination.

The ratio of polyhydric alcohol to polyvalent carboxylic acid, specifically the equivalent ratio (OH)/(COOH) of hydroxy groups (OH) of the polyhydric alcohol to the carboxy groups (COOH) of the polyvalent carboxylic acid is preferably within the range of 1.5/1 to 1/1.5, more preferably 1.2/1 to 1/1.2.

The number average molecular weight (Mn) of the amorphous polyester resin component is preferably within the range of 2,000 to 10,000.

The glass-transition temperature (Tg) of the amorphous polyester resin component is preferably within the range of 20° C. to 70° C. The glass-transition temperature (Tg) can be measured through the same method as that for the amorphous vinyl resin component.

The amorphous polyester resin may be hybrid resin modified with styrene acrylic resin.

The styrene acrylic resin portion of the amorphous polyester resin or hybrid resin has high compatibility with the amorphous vinyl resin. Thus, the amorphous polyester resin portions are uniformly dispersed in a toner particle. For a toner particle that has a core-shell structure and a shell layer containing the amorphous polyester resin component, the amorphous polyester resin component readily agglomerates at the surface of the core containing the amorphous vinyl resin. Thus, the entire surface of the core is readily covered with the amorphous polyester resin.

The amorphous polyester resin modified with styrene acrylic resin is equivalent to an amorphous polyester resin segment chemically bonded to a styrene acrylic resin segment. The amorphous polyester resin segment of the hybrid resin refers to the resin component derived from the amorphous polyester resin, i.e., molecular chains having the same chemical structure as the amorphous polyester resin. The styrene acrylic resin segment of the hybrid resin refers to the resin component derived from the styrene acrylic resin, i.e., molecular chains having the same chemical structure as the styrene acrylic resin.

The styrene acrylic resin is a polymer of styrenic monomers and (meth)acrylic acid monomers.

Examples of the styrenic monomers include monomers having a styrene structure, such as styrene, o-methylstyrene, m-methylstyrene, p-methylstyrene, p-methoxylstyrene, p-phenyl styrene, p-chlorostyrene, p-ethyl styrene, p-n-butyl styrene, p-tert-butyl styrene, p-n-hexyl styrene, p-n-octyl styrene, p-n-nonylstyrene, p-n-decylstyrene, p-n-dodecylstyrene, 2,4-dimethyl styrene, 3,4-dichlorostyrene, and derivatives thereof. These compounds may be used alone or in combination.

Examples of (meth)acrylic acid monomers include monomers having (meth)acryl groups, such as acrylic acid, methacrylic acid, methyl acrylate, ethyl acrylate, butyl acrylate, acrylic acid-2-ethylhexyl, cyclohexyl acrylate, phenyl acrylate, methyl methacrylate, ethyl methacrylate, butyl methacrylate, hexyl methacrylate, 2-ethylhexyl methacrylate, 6-hydroxy ethyl acrylate, γ-aminoacrylate, stearyl methacrylate, dimethylaminoethyl methacrylate, diethylaminoethyl methacrylate, 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and poly(ethylene glycol) mono(meth)acrylate. These compounds may be used alone or in combination.

In addition to the styrenic monomers and the (meth) acrylic acid monomers, any other monomer may be used. Example of such monomers include maleic acid, itaconic acid, cinnamic acid, fumaric acid, maleic acid monoalkyl esters, and itaconic acid monoalkyl esters.

Styrene acrylic resin can be prepared by adding any typical polymerization initiator, such as a peroxide, persulfide, or azo compound, to the monomers listed above and polymerizing the monomers through any known polymerization technique, such as bulk polymerization, solution polymerization, emulsion polymerization, miniemulsion polymerization, suspension polymerization, or dispersion polymerization. A typical chain transfer agent, such as alkyl mercaptan or mercapto fatty acid ester, may be used during polymerization for the purpose of adjustment of molecular weight.

The content of the styrene acrylic resin segment in the hybrid resin is preferably within the range of 1 to 30 mass %, to achieve ready control of the plasticity of the toner particles.

The hybrid resin can be acquired through chemical bonding of the amorphous polyester resin and the styrene acrylic resin, which are separately prepared.

In view of ready bonding, it is preferred that either the amorphous polyester resin or the styrene acrylic resin have a substituent that is reactive with both the amorphous polyester resin and the styrene acrylic resin. For example, during preparation of the styrene acrylic resin, a compound having a substituent that is reactive with the carboxy group (COOH) or the hydroxy group (OH) of the amorphous polyester resin and another substituent that is reactive with the styrene acrylic resin are added to the styrenic monomers and the acid monomers, i.e., raw material. This yields a styrene acrylic resin having a substituent that is reactive with the carboxy group (COOH) or the hydroxy group (OH) of the amorphous polyester resin.

The hybrid resin can be prepared through polymerization of the styrene acrylic resin in the presence of the amorphous polyester resin or polymerization of the amorphous polyester resin in the presence of the styrene acrylic resin. In any polymerization process, a compound having a substituent that is reactive with both the amorphous polyester resin and the styrene acrylic resin may be added.

The number average molecular weight (Mn) of the hybrid resin is preferably within the range of 2,000 to 10,000, in view of sufficient fixing properties of the toner.

The content of the amorphous polyester resin component in the toner particles is preferably within the range of 1 to 50 mass %, in view of sufficient fixing properties of the toner and a stable environment for electrical charging.

(Crystalline Resin)

According to the present invention, crystalline resin has a melting point, i.e., clear endothermic peak during a temperature rise, in an endothermic curve obtained through DSC. A clear endothermic peak in an endothermic curve has a half width of 15° C. or less at a heating rate of 10° C./min.

Examples of the crystalline resin that can be used in the toner for developing electrostatic images according to the present invention include crystalline polyester resins, crystalline polyamide resins, crystalline polyurethane resins, crystalline polyacetal resins, crystalline poly(ethylene terephthalate) resins, crystalline polybutylene terephthalate resins, crystalline polyphenylene sulfide resins, crystalline polyether ether ketone resins, and crystalline polytetrafluoroethylene resins.

The crystalline polyester resins are particularly preferred in view of its compatibility between sufficient fixing properties of the toner at low temperatures and heat resistance of the toner during storage.

The crystalline polyester resin is produced through polycondensation of carboxylic acid having a valency of two or more (polyvalent carboxylic acid) and alcohol having two or more hydroxy groups (polyhydric alcohol). The same polyvalent carboxylic acid and polyhydric alcohol may be used as those used for the amorphous polyester resin described above.

The content of the crystalline resin component in the toner particles is preferably within the range of 1 to 20 mass %, more preferably 5 to 15 mass %, in view of sufficient fixing properties of the toner at low temperatures and heat resistance of the toner during storage. The amorphous vinyl resin uniformly disperses the crystalline resin component having a content within such a range in the toner particles, to sufficiently prevent crystallization.

The melting point (Tm) of the crystalline resin component according to the present invention is preferably within the range of 50° C. to 90° C., more preferably 60° C. to 80° C., in view of sufficient fixing properties of the toner at low temperatures and heat resistance of the toner during storage.

The melting point (Tm) can be measured by DSC. In detail, a sample of crystalline resin is sealed in an aluminum pan (Kit No. B0143013) placed in a sample holder of a thermal analyzer Diamond DSC (manufactured by PerkinElmer, Inc.) and exposed to a heat cycle involving heating, cooling, and reheating. During the first heating stage, the temperature is raised from room temperature (25° C.) to 150° C. During the second heating stage, the temperature is raised from 0° C. to 150° C. at a heating rate of 10° C./min and kept at 150° C. for five minutes. During the cooling stage, the temperature is reduced from 150° C. to 0° C. at a cooling rate of 10° C./min and kept at 0° C. for five minutes. The temperature corresponding to the endothermic peak in the endothermic curve obtained during the second heating stage is determined to be the melting point (Tm).

The weight average molecular weight (Mw) of the crystalline resin component according to the present invention is preferably within the range of 5,000 to 50,000, and the number average molecular weight (Mn) is preferably within the range of 2,000 to 10,000, in view of sufficient fixing properties of the toner at low temperatures and stability in gloss of the toner.

(Colorant)

Any known dye or pigment may be used as a colorant.

Examples of such dyes include C. I. Solvent Reds 1, 49, 52, 58, 63, 111, and 122, C. I. Solvent Yellows 19, 44, 77, 79, 81, 82, 93, 98, 103, 104, 112, and 162, and C. I. Solvent Blues 25, 36, 60, 70, 93, and Examples of such pigments include C. I. Pigment Reds 5, 48:1, 48:3, 53:1, 57:1, 81:4, 122, 139, 144, 149, 150, 166, 177, 178, 222, 238, and 269, C. I. Pigment Oranges 31 and 43, C. I. Pigment Yellows 14, 17, 74, 93, 94, 138, 155, 156, 158, 180, and 185, C. I. Pigment Green 7, and C. I. Pigment Blues 15:3 and 60.

Other examples of pigments include carbon blacks, such as channel black, furnace black, acetylene black, thermal black, and lamp black, and black iron oxides, such as magnetite, hematite, and titanium-iron oxide.

These materials may be used alone or in combination, to prepare a toner of a desired color.

The content of the colorant in the toner particles is preferably within the range of 1 to 10 mass % in view of sufficient color reproduction of the toner.

The toner for developing electrostatic images according to the present invention may further contain other components, such as external additives, a release agent, and a charge controlling agent, as required.

(External Additives)

The toner particles as they are can be used as a toner. However, the toner may contain any external additive in view of enhancement of fluidity, electrostatic properties, and cleanability.

Examples of the external additives include inorganic and organic particles and lubricants. These materials may be used alone or in combination.

The inorganic particles may be composed of silica, titania, alumina, or titanate strontium. The organic particles may be composed of styrene or methyl methacrylate. The inorganic particles may be hydrophobized.

A lubricant may be added to enhance the cleanability and transferability of the toner. Examples of lubricants include metal salts, such as stearic acid, oleic acid, palmitic acid, and linoleic acid. Examples of metals of the metal salt include zinc, manganese, iron, copper, and magnesium.

Spherical silica particles having an average primary particle diameter within the range of 70 to 200 nm is preferred for superior fluidity and electrostatic properties of the toner particles.

The average primary particle diameter can be measured as follows:

The silica particles are captured with a scanning electron microscope JSM-7401F (manufactured by JEOL Ltd.) at a magnification of 30000×. The captured image is read by a scanner. The scanned image is binarized with an image processor/analyzer LUZEX (trademark) AP (manufactured by Nireco Corporation). The Feret diameter in the horizontal direction of 100 silica particles residing on the surface of the toner in the image are calculated, and the average is determined as the average primary particle diameter. The Feret diameter in the horizontal direction equals the length of a side of a rectangle along the x axis, the rectangle being tangent to the outline of the silica particle.

The content of the external additives in the toner particles may be within the range of 0.1 to 10.0 mass %.

(Release Agent)

The release agent may be any known wax. Examples of the release agent include polyolefin waxes, such as polyethylene wax and polypropylene wax; branched linear hydrocarbon waxes, such as microcrystalline wax; long-chain hydrocarbon waxes, such as paraffin wax and Sasolwax; dialkyl ketone waxes, such as distearyl ketone; ester waxes, such as carnauba wax, montan wax, behenyl behenate, trimethylolpropane behenate, pentaerythritol tetrabehenate, pentaerythritol diacetate dibehenate, glycerol tribehenate, 1,18-octadecanediol distearate, tristearyl trimellitate, and distearyl maleate; and amide wax, such as ethylenediaminebehenylamide and trimellitic acid tristearyl amide.

In view of enhancement of the releasing ability of the toner during fixing at low temperatures, it is preferred that the wax have a melting point within the range of 40° C. to 90° C.

The content of the release agent in the toner particles may be within the range of 0.5 to 10 mass %, preferably 3 to 7 mass %.

(Charge Controlling Agent)

The charge controlling agent may be any known compound including nigrosine dye, metal salts, such as naphthenic acid and higher fatty acid, alkoxylated amine, quaternary ammonium salt, an azo-metal complex, and salicylic acid metal salt.

The content of the charge controlling agent in the toner particles may be within the range of 0 to 5 mass %, preferably 0 to 0.5 mass %.

[Structure of Toner for Developing Electrostatic Images]

The toner particles of the toner for developing electrostatic images according to the present invention may have a single layer structure including only the toner particles or a multi-layer structure, such a core-shell structure including a toner particle or core particle covered with a shell layer. The shell layer may not necessarily cover the entire core particle, in other words, the core particle may be partially exposed. A cross-section of a core-shell structure can be observed with a known technique, such as a transmission electron microscope (TEM) or a scanning probe microscope (SPM).

In a core-shell structure, the core particle and the shell layer may have different properties including glass transition temperatures, melting points, and hardness values, so as to design toner particles suitable for a purpose. For example, resin having a relatively high glass-transition temperature (Tg) is agglomerated and fused to the surface of a core particle containing a binder resin, a colorant, and a release agent and having a relatively low glass-transition temperature (Tg), to form a shell layer. The shell layer may be composed of the amorphous polyester resin described above, preferably an amorphous polyester resin modified with a styrene acrylic resin.

[Characteristics of Toner for Developing Electrostatic Images]

(Glass-Transition Temperature)

The toner for developing electrostatic images according to the present invention has a glass-transition temperature (Tg) preferably within the range of 50° C. to 70° C., more preferably 55° C. to 65° C.

If the glass-transition temperature is within the range mentioned above, the toner can establish compatibility between sufficient fixing properties at low temperatures and heat resistance during storage. The toner can maintain its heat resistance (thermal strength), and have sufficient heat resistance during storage and resistance to hot-offset.

The glass-transition temperature (Tg) can be measured through the same methods as those for the amorphous vinyl resin.

(Melting Point)

The toner for developing electrostatic images according to the present invention has a melting point (Tm) preferably within the range of 60° C. to 90° C., more preferably 65° C. to 80° C.

If the melting point is within the range mentioned above, the toner can establish compatibility between sufficient fixing properties at low temperatures and heat resistance during storage. The toner can also maintain its heat resistance (thermal strength) and have sufficient heat resistance during storage.

The melting point (Tm) can be measured through the same methods as those for the crystalline polyester resin.

(Diameter of Toner Particles)

The toner for developing electrostatic images according to the present invention has a volume-based median diameter of the toner particles preferably within the range of 3 to 8 μm, more preferably 5 to 8 μm.

A toner having a volume-based median diameter within such a range can precisely produce high-resolution dots on the order of 1,200 dpi.

The volume-based median diameter can be controlled by the concentration of the agglomerating agent used during preparation, the volume of the organic solvent, the time of fusion, and the composition of the binder resin.

The volume based median diameter can be measured with a measuring device including Multisizer 3 (manufactured by Beckman Coulter, Inc.) connected to a computer system loaded with Software V3.51 for data processing.

In detail, a sample of toner (0.02 g) is wetted with a surfactant solution (20 mL) (a neutral detergent, having a surfactant component, 10-fold diluted with pure water prepared for dispersion of the toner particles). The mixture is dispersed for one minute through ultrasonic dispersion, to prepare a toner dispersion. The toner dispersion is introduced to a beaker with a pipet placed in Isoton II (manufactured by Beckman Coulter, Inc.) on a sample stand until the concentration displayed on the measuring device reaches 8%. This concentration achieves reproducible measurements.

The measuring device is used to count 25,000 particles to be measured, establish an aperture diameter of 100 μm, calculate the frequency in the measuring range divided by 256, the measuring range being between 2 and 60 μm, and determine the particle diameter of the larger 50% of the volumetric integration as the volume-based median diameter.

(Average Roundness of Toner Particles)

The particles of the toner for developing electrostatic images according to the present invention have an average roundness preferably within the range of 0.930 to 1.000, more preferably 0.950 to 0.995.

Toner particles having an average roundness within such a range are not damaged and do not contaminate the charging component, to stabilize the chargeability of the toner. This also achieves formation of high quality toner images.

The average roundness of the toner can be measured as follows:

A toner dispersion is prepared through the same process as in the measurement of the median diameter. An image of the toner dispersion is captured with analyzers FPIA-2100 and FPIA-3000 (both manufactured by Sysmex Corporation) in a high power field (HPF) mode at an appropriate concentration within the range of 3,000 to 10,000 particles detectable in HPF mode, to calculate the roundness of every toner particle by the following expression (y). The sum of the roundness of every toner particle is divided by the number of toner particles, to calculate the average roundness. If the number of particles detected in the HPF mode is within the appropriate concentration mentioned above, the toner can reproduce a sufficient image.

Roundness=(circumference of circle having same area as projected image of particle)/(circumference of projected image of particle) Expression (y)

[Developer]

The toner for developing electrostatic images according to the present invention may be used as a magnetic or non-magnetic single-component developer or may be mixed with a carrier to be used as a two-component developer.

The carrier for a two-component developer may be in the form of magnetic particles composed of known materials including metals, such as iron, ferrite, and magnetite, and alloys of these metals with other metals, such as aluminum and lead.

The carrier may be a coated carrier in which magnetic particles are coated with a coating material, such as silicone resin, or a dispersed carrier in which a magnetic powder is dispersed in a binder resin.

The carrier has an average particle diameter or volume-based median diameter preferably within the range of 20 to 100 μm, more preferably 25 to 80 μm.

The volume-based median diameter of the carrier can be typically measured with a laser diffraction particle-size distribution measuring device HELOS (manufactured by Sympatec GmbH).

[Production of Toner for Developing Electrostatic Images]

The toner for developing electrostatic images according to the present invention can be produced through emulsification aggregation or phase-transfer emulsification. Emulsification aggregation is preferred in view of ready production. In detail, a dispersion of the crystalline resin in an aqueous medium, a dispersion of amorphous resin in an aqueous medium, and a dispersion of colorant in an aqueous medium are mixed, and the crystalline resin particles, the amorphous resin particles, and the colorant particles in the mixed aqueous media can be agglomerated and fused into toner particles.

(Preparation of Resin Particle Dispersion)

The amorphous resin and the crystalline resin are dispersed in respective aqueous media to prepare a dispersion of amorphous resin particle and a dispersion of crystalline resin particle.

An aqueous medium contains water by 50 mass % or more. Examples of the content of the aqueous medium other than water include organic solvents that dissolve in water, such as methanol, ethanol, 2-propanol, butanol, acetone, methyl ethyl ketone, and tetrahydrofuran. Among these compounds, organic alcohol solvents that do not dissolve resin, such as methanol, ethanol, 2-propanol, and butanol, are preferred.

Any technique may be used to produce the amorphous resin and the crystalline resin. For example, emulsion polymerization may be performed by adding monomers of resin to an aqueous medium together with a polymerization initiator and polymerizing the monomers, to prepare a resin particle dispersion.

Emulsion polymerization may be performed in multiple steps. For example, in a three-step polymerization process, a resin particle dispersion is prepared in the first polymerization step. In the second polymerization step, monomers of resin and a polymerization initiator are added to this dispersion for polymerization. In the third polymerization step, more monomers of resin and an additional polymerization initiator are further added to the dispersion prepared in the second polymerization step for polymerization. In the second and third polymerization steps, the resin particles generated in the dispersion in the previous polymerization steps can be used as seeds for polymerization of further added monomers, to produce resin particles with uniform diameters. Different monomers may be used in the respective polymerization steps to produce resin particles with a multilayer structure. This readily produces resin particles with desired characteristics.

When producing the amorphous vinyl resin described above through polymerization in multiple steps, monomers having a structure represented by formula (1) should be added during each step. The monomers may be added in at least one of the steps or in all of the steps. When the monomers are added only in the first step, the particles composed of different materials will fuse and mix in each step of the production process of the toner. Thus, the branched alkyl groups in the amorphous vinyl resin sufficiently react with the crystalline resin.

The dispersion may be prepared through any method other than emulsion polymerization. For example, phase-transfer emulsification may be applied in which an oil-phase fluid is prepared by dissolving or dispersing resin in an organic solvent, and dispersing oil droplets having a target diameter in an aqueous medium through phase-transfer emulsification of the oil-phase fluid.

(Polymerization Initiator)

Any known polymerization initiator may be used. Examples of such polymerization initiators include persulfates, such as ammonium persulfate, sodium persulfate, and potassium persulfate; azo compounds, such as 2,2'-azobis (2-aminodipropane) dihydrochloride, 2,2'-azobis-(2-aminodipropane) nitrate, 4,4'-azobis-4-cyanovaleric acid, poly(tetraethylene glycol 2,2'-azobisisobutyrate); and peroxides, such as hydrogen peroxide.

The quantity of the polymerization initiator to be added depends on the target molecular weight and/or the molecular weight distribution. Specifically, the polymerization initiator may be added within the range of 0.1 to 5.0 mass % relative to the quantity of the polymerizable monomers.

(Chain Transfer Agent)

A chain transfer agent may be added to the polymerizable monomers during polymerization to control the molecular weight of the resin particles.

Examples of chain transfer agents that can be used include mercaptan, such as octyl mercaptan, and mercaptopropionic acid, such as n-octyl 3-mercaptopropionate.

The quantity of the chain transfer agent depends on the target molecular weight and/or the molecular weight distribution. Specifically, the chain transfer agent may be added within the range of 0.1 to 5.0 mass % relative to the quantity of the polymerizable monomers.

(Surfactant)

A surfactant can be added to the polymerizable monomers during polymerization in view of prevention of agglomeration of resin particles in the dispersion and a satisfactory dispersed state.

The surfactant may be any known surfactant. Examples of such surfactants include cationic surfactants, such as dodecyl ammonium bromide and dodecyl trimethylammonium bromide; anionic surfactants, such as sodium stearate, sodium lauryl sulfate (dodecyl sodium sulfate), and sodium dodecylbenzenesulfonate; and nonionic surfactants, such as dodecyl polyoxyethylene ether and hexadecyl polyoxyethylene ether. These surfactants may be used alone or in combination.

Dispersion can be performed by mechanical energy with a homogenizer, a shear disperser, a friction disperser, a high-pressure disperser, an ultrasound disperser, a high-pressure impact disperser, or other dispersers.

(Preparation of Colorant Particle Dispersion)

A colorant is dispersed in an aqueous medium to prepare a colorant particle dispersion.

The surfactants described above may be added to the colorant particle dispersion during preparation, to enhance stability of the dispersed colorant particles. The mechanical energy mentioned above may be used in the dispersing process.

The colorant particles in the dispersion have a volume-based median diameter preferably within the range of 10 to 300 nm, more preferably 100 to 200 nm, most preferably 100 to 150 nm.

The volume-based median diameter of the colorant particles can be measured with an electrophoretic light scattering photometer ELS-800 (manufactured by Otsuka Electronics Co., Ltd.).

When additives, such as a release agent and a charge controlling agent, are to be added, the additives may be dispersed in respective aqueous media to prepare dispersions through the same preparation process of the resin particle dispersion, as described above. Alternatively, the additives and the amorphous resin may be added together to an aqueous medium during preparation of the dispersion of amorphous resin particles.

(Formation of Toner Particles)

The prepared amorphous resin dispersion, a dispersion of crystalline resin particles, and a dispersion of colorant particles are mixed, and amorphous resin particles, crystalline resin particles, and colorant particles agglomerate in the aqueous medium. Aqueous dispersions, such as a release agent, may be mixed and agglomerated, if necessary. The mixture is heated to fuse the particles into toner particles. If a release agent is to be used, the dispersion of release agent particles is mixed to agglomerate and fuse the release agent particles as well. An agglomerating agent may be added to the mixture at a concentration higher than a critical agglomeration concentration during agglomeration and fusing, and the mixture may be heated to a temperature higher than the glass-transition temperature (Tg) of the amorphous resin, to promote agglomeration and fusion.

(Agglomerating Agent)

Any agglomerating agent may be used. Examples of such agglomerating agents include metal salts, such as alkali metal salt and alkaline earth metal salt.

Examples of metal salts include monovalent metal salts, such as sodium chloride, potassium chloride, and lithium chloride; divalent metal salts, such as calcium chloride, magnesium chloride, copper sulfate, and magnesium sulfate; and trivalent metal salts, such as iron and aluminum. A divalent metal salt is preferred for agglomeration at small volumes.

(Aging)

The toner particles may be aged, if necessary. In the aging process, the toner particle dispersion acquired in the formation process described above is heated and aged until toner particles having a target roundness are produced.

(Shell Formation)

To produce toner particles having a core-shell structure, the toner particles or core particles produced through the formation and aging processes described above are coated with a shell layer.

In detail, a resin particle dispersion is prepared by dispersing a resin that forms the shell layer in an aqueous medium and added to the toner particle dispersion prepared through the formation and aging processes described above, to agglomerate and fuse resin particles that constitute the shell layer on the surface of the toner particles. In this way, a toner particle dispersion is prepared that contains toner particles having a core-shell structure.

After formation of the shell layer, the toner particles can be heated to achieve tight agglomeration and fusion of the resin particles in the shell to the core. The toner particles can be heated until a desired roundness of the toner particles is achieved.

(Cooling)

The toner particle dispersion prepared through the formation, aging, and/or shell formation processes is cooled.

The cooling rate may be within the range of 1 to 20° C./min. Any cooling process may be applied. For example, a coolant may be introduced from outside the reactor or cold water may be directly introduced to the reacting system.

(Filtering and Washing)

The cooled toner particle dispersion is filtered to separate solids and liquid. The separated wet toner cake (a cake-shaped agglomeration of toner particles) is washed to remove any surfactants and agglomerating agents.

The solids and liquid may be separated through centrifugation, filtration under reduced pressure with a Buchner funnel, for example, or filtration with a filter press.

The toner cake can be washed with water until the filtered liquid has an electrical conductivity of 10 μS/cm.

(Drying)

The filtered and washed toner cake is dried.

The toner cake can be dried using a spray dryer, a vacuum freeze dryer, a depressurizing dryer, a stationary tray dryer, a mobile tray dryer, a fluidized bed dryer, a tumbler dryer, or an agitated dryer, for example.

The water content in the dried toner particles is preferably 5 mass % or less, more preferably 2 mass % or less.

If the toner particles form agglomerations by weak interparticle forces, the agglomeration may be disintegrated. A disintegrator may be used, such as a jet mill, a Henschel mixer, a coffee mill, or a food processor.

(Addition of External Additives)

External additives to be added to the toner particles are optionally mixed with the dried toner particles.

A mixer, such as a Henschel mixer or a coffee mill, may be used for addition of external additives.

EXAMPLES

The present invention will now be described in further detail by reference to the following examples. These examples should not be construed to limit the present invention. In the examples, the term "parts" and the sign "%" refer to "parts by mass" and "mass %," respectively, unless otherwise specified.

[Toner 1]

(Preparation of Dispersion of Crystalline Polyester Resin Particles)

In a reactor equipped with an agitator, a thermometer, a cooling tube, and a nitrogen-gas inlet pipe, 1,10-decanedicarboxylic acid (dodecanedioic acid) (315 parts by mass) and 1,9-nonanediol (252 parts by mass) were placed. After the reactor was purged with dry nitrogen gas, titanium tetrabutoxide (0.1 parts by mass) was added to the mixture and mixed by agitation for 8 hours under a nitrogen gas stream at 180° C., for polymerization. Titanium tetrabutoxide (0.2 parts by mass) was further added to the mixture and mixed by agitation for 6 hours at an elevated temperature of 220° C., for polymerization. The internal pressure of the reactor was reduced to 10 mmHg, and a dispersion of crystalline polyester resin particles was prepared through polymerization under the reduced pressure.

The weight average molecular weight (Mw) of the resulting crystalline polyester resin was 14,000. The weight average molecular weight (Mw) was determined from a molecular weight distribution measured by GPC, as follows:

A sample of the crystalline polyester resin was added to tetrahydrofuran (THF) into a concentration of 1 mg/mL and was dispersed with an ultrasonic disperser for five minutes at room temperature. The mixture was treated with a membrane filter having a pore size of 0.2 μm to prepare a solution. Tetrahydrofuran, which is a carrier solvent, was circulated at a flow rate of 0.2 mL/min through a GPC device HLC-8120GPC (manufactured by Tosoh Corporation), a TSK guard column, and three columns of TSK gel Super HZ-m (manufactured by Tosoh Corporation) at a constant column temperature of 40° C. The carrier solvent and 10 μL of the resulting solution were injected to the GPC device. The solution was detected with a refractive-index (RI) detector, and the molecular weight distribution of the solution was calculated on the basis of a calibration curve prepared through measurement of monodispersed polystyrene standard materials. The weight average molecular weight (Mw) was derived from the calculated molecular weight distribution. Ten samples of polystyrene were used for measurement of the calibration curve.

The melting point (Tm) of the crystalline polyester resin was 72° C. The melting point was measured through differential scanning calorimetry (DSC), as described below.

A sample of the crystalline polyester resin (1.5 mg) was sealed in an aluminum pan and exposed to a heat cycle involving heating, cooling, and reheating. During the first heating stage, the temperature was raised from room temperature (25° C.) to 150° C. During the second heating stage, the temperature was raised from 0° C. to 150° C. at a heating rate of 10° C./min and kept at 150° C. for five minutes. During the cooling stage, the temperature was reduced from 150° C. to 0° C. at a cooling rate of 10° C./min and kept at 0° C. for five minutes. The temperature corresponding to the endothermic peak in the endothermic curve obtained during the second heating stage was determined to be the melting point. An empty aluminum pan was used as a reference.

(Preparation of Dispersion of Amorphous Vinyl Resin Particles)

(First Polymerization Step)

Dodecyl sodium sulfate (8 parts by mass) and ion-exchanged water (3,000 parts by mass) were placed in a 5-L reactor equipped with an agitator, a temperature sensor, a cooling tube, and a nitrogen introducer, mixed by agitation at 230 rpm under a nitrogen gas stream while the internal temperature was raised to 80° C. After the temperature reached 80° C., a solution of potassium persulfate (10 parts by mass) in ion-exchanged water (200 parts by mass) was added, and the temperature of the liquid was raised again to 80° C. The following liquid mixture of monomers was then added dropwise over one hour:

styrene, 480.0 parts by mass;
n-butyl acrylate, 250.0 parts by mass; and
methacrylic acid, 68.0 parts by mass.

After the monomers were added dropwise, the mixture was heated at 80° C. for two hours and mixed by agitation for polymerization, to prepare a dispersion of amorphous vinyl resin particles.

(Second Polymerization Step)

A solution of sodium polyoxyethylene (2) dodecyl ether sulfate (7 parts by mass) in ion-exchanged water (3,000 parts by mass) was placed in a 5-L reactor equipped with an agitator, a temperature sensor, a cooling tube, and a nitrogen introducer, and was heated to 98° C. The dispersion of amorphous vinyl resin particles prepared in the first polymerization step (80 parts by mass of solid content) and the following mixture prepared by dissolving monomers, a chain transfer agent, and a release agent at 90° C. were added to the heated solution:

styrene (St), 285.0 parts by mass;
n-butyl acrylate (BA), 95.0 parts by mass;
methacrylic acid (MAA), 20.0 parts by mass;
n-octyl 3-mercaptopropionate (chain transfer agent), 1.5 parts by mass; and
behenyl behenate (release agent, melting point of 73° C.) 190.0 parts by mass.

The solution was mixed and dispersed for one hour in a mechanical disperser Clearmix having a circulation path (manufactured by M Technique Co., Ltd.), to prepare a dispersion containing emulsified particles (oil droplets). A solution of polymerization initiator prepared by dissolving potassium persulfate (6 parts by mass) in ion-exchanged water (200 parts by mass) was added to the dispersion. The mixture was heated and mixed by agitation for one hour at 84° C. for polymerization, to prepare a dispersion of amorphous vinyl resin particles.

(Third Polymerization Step)

Ion-exchanged water (400 parts by mass) was further added to the dispersion of amorphous vinyl resin particles prepared in the second polymerization step and thoroughly mixed. A solution of potassium persulfate (11 parts by mass) in ion-exchanged water (400 parts by mass) was further added to the mixture. The following mixture of monomers and a chain transfer agent was added dropwise over one hour under a temperature condition of 82° C.:

styrene (St), 454.8 parts by mass;
2-ethylhexyl acrylate (2EHA), 143.2 parts by mass;
methacrylic acid (MAA), 52.0 parts by mass; and
n-octyl 3-mercaptopropionate, 8.0 parts by mass.

After the mixture was added dropwise, the solution was heated and mixed by agitation for two hours for polymerization, and was cooled to 28° C. to prepare a dispersion of amorphous vinyl resin particles.

The amorphous vinyl resin particles in the dispersion had a volume-based median diameter of 220 nm and a weight average molecular weight (Mw) of 32,000. The weight average molecular weight (Mw) was measured through the same method as that for the crystalline polyester resin.

The amorphous vinyl resin particles in the dispersion had a glass-transition temperature (Tg) of 55° C.

The glass-transition temperature (Tg) was measured with a thermal analyzer Diamond DSC (manufactured by PerkinElmer, Inc.). In detail, a sample of the amorphous vinyl resin (1.5 mg) was sealed in an aluminum pan and exposed to a heat cycle involving heating, cooling, and reheating. During the first heating stage, the temperature was raised from room temperature (25° C.) to 150° C. During the second heating stage, the temperature was raised from 0° C. to 150° C. at a heating rate of 10° C./min and kept at 150° C. for five minutes. During the cooling stage, the temperature was reduced from 150° C. to 0° C. at a cooling rate of 10° C./min and kept at 0° C. for five minutes. The shift of the base line in the measured curve obtained during the second heating stage was observed and the intersection of a line extending from the unshifted base line and a tangent corresponding to the maximum slope of the shifted base line was determined to be the glass-transition temperature (Tg). An empty aluminum pan was used as a reference.

(Preparation of Dispersion of Amorphous Polyester Resin Particles of Shell Layer)

A mixture of monomers of a styrene acrylic resin, a monomer having substituents that is reactive with both the amorphous polyester resin and the styrene acrylic resin, and a polymerization initiator were placed in a dropping funnel:

styrene, 80.0 parts by mass;
n-butyl acrylate, 20.0 parts by mass;
acrylic acid, 10.0 parts by mass; and
di-t-butyl peroxide (polymerization initiator), 16.0 parts by mass.

The following monomers of amorphous polyester resin were placed in a four-neck flask equipped with a nitrogen inlet pipe, a dewatering pipe, an agitator, and a thermocouple, and were dissolved at 170° C.:

propylene oxide (2 mol) adduct of bisphenol A, 285.7 parts by mass;

terephthalic acid, 66.9 parts by mass; and fumaric acid, 47.4 parts by mass.

The mixture placed in the dropping funnel was transferred dropwise to the four-neck flask over 90 minutes while the content in the flask was agitated and was then aged for 60 minutes. The unreacted monomers were eliminated under reduced pressure (8 kPa). An esterification catalyst $Ti(OBu)_4$ (0.4 parts by mass) was added. The mixture was then heated to 235° C. and reacted for five hours under normal pressure (101.3 kPa) and then for one hour under reduced pressure (8 kPa).

The mixture was cooled to 200° C. and reacted under reduced pressure (20 kPa). The solvent was removed to yield an amorphous polyester resin modified with a styrene acrylic resin. The resulting amorphous polyester resin had a weight average molecular weight (Mw) of 25,000 and a glass-transition temperature (Tg) of 60° C. The weight average molecular weight (Mw) was measured through the same method as that for the crystalline polyester resin, and the glass-transition temperature (Tg) was measured through the same method as that for the amorphous vinyl resin.

The resulting amorphous polyester resin (100 parts by mass) was dissolved in ethyl acetate (400 parts by mass) (manufactured by Kanto Chemical Co., Inc.) and mixed with a preliminarily prepared sodium lauryl sulfate solution (638 parts by mass) having a concentration of 0.26 mass %. While mixed by agitation, the mixture was dispersed for 30 minutes with an ultrasonic homogenizer US-150T (manufactured by Nissei Corporation) at a voltage level of 300 μA. Ethyl acetate was completely eliminated from the mixture heated to 40° C. with a diaphragm vacuum pump V-700 (manufactured by Buchi Corporation) under reduced pressure for three hours while the mixture was mixed by agitation, to prepare a dispersion of amorphous polyester resin particles, containing a solid component of 13.5 mass %. The amorphous polyester resin particles in the dispersion had a volume-based median diameter of 160 nm.

(Preparation of Colorant Particle Dispersion)

Copper phthalocyanine (C. I. Pigment Blue 15:3) (420 parts by mass) was gradually added to an agitated solution of dodecyl sodium sulfate (90 parts by mass) in ion-exchanged water (1,600 parts by mass). The solution was dispersed with an agitator Clearmix (manufactured by M Technique Co., Ltd.), to prepare a colorant particle dispersion.

The colorant particles in the dispersion had a volume-based median diameter of 110 nm.

(Production of Toner 1)

The dispersion of amorphous vinyl resin particles (288 parts by mass of solid content), the dispersion of crystalline polyester resin particles (40 parts by mass of solid content), dodecyl diphenyl ether disulfonic acid sodium salt (1 mass % of solid content), and ion-exchanged water (2,000 parts by mass) were placed in a reactor equipped with an agitator, a temperature sensor, and a cooling tube. An aqueous sodium hydroxide solution (5 mol/L) was added to the mixture under room temperature (25° C.) to adjust the pH to 10.

The colorant particle dispersion (30 parts by mass of solid content) was further added to the mixture, and a solution of magnesium chloride (60 parts by mass) in ion-exchanged water (60 parts by mass) was added over 10 minutes at 30° C. while the mixture was agitated. The mixture was allowed to stand for three minutes and then heated to 80° C. over 60 minutes. After the temperature reached 80° C., the agitation rate was adjusted such that the growth rate of the particle diameter was 0.01 μm/min, and the particles were grown until the volume-based median diameter measured with a Coulter Multisizer 3 (manufactured by Beckman Coulter, Inc.) was 6.0 μm.

The dispersion of amorphous polyester resin particles (37 parts by mass of solid content) was added to the mixture over 30 minutes. When the supernatant of the mixture became clear, a solution of sodium chloride (190 parts by mass) in ion-exchanged water (760 parts by mass) was added to the mixture, to stop the growth of the particles. The mixture was then heated to 80° C. and mixed by agitation to promote the fusion of the particles. When the average roundness of the toner particles reached 0.970, the mixture was cooled to 30° C. at a rate of 2.5° C./min. The average roundness was measured with a measuring device FPIA-3000 (manufactured by Sysmex Corporation) for 4,000 particles detected in the HPF mode.

Toner cake was prepared by solid-liquid separation and dehydration and washed by three cycles of dispersion of the toner cake in ion-exchanged water and solid-liquid separation. The washed toner cake was dried for 24 hours at 40° C., to prepare toner particles.

Hydrophobic silica particles (having an average primary particle diameter of 12 nm and a hydrophobicity of 68) (0.6 parts by mass), hydrophobic titanium oxide particles (having an average primary particle diameter of 20 nm and a hydrophobicity of 63) (1.0 parts by mass), and sol-gel silica (having an average primary particle diameter of 110 nm) (1.0 parts by mass) were added to the resulting toner particles (100 parts by mass), and mixed for 20 minutes at 32° C. with a Henschel mixer (manufactured by Mitsui Miike Machinery Co., Ltd.) at a peripheral rotary blade velocity of 35 mm/sec. The mixed particles were sifted through a 45 μm mesh, and coarse particles were removed, to prepare toner 1.

[Toner 2]

Toner 2 was produced as in toner 1, except that during preparation of the dispersion of amorphous vinyl resin particles, the mixture of monomers used in the third polymerization step was replaced with a mixture of monomers having the following composition:

styrene (St), 435.6 parts by mass;

2-ethylhexyl acrylate (2EHA), 64.4 parts by mass;

n-butyl acrylate, 98.0 parts by mass;

methacrylic acid (MAA), 52.0 parts by mass; and n-octyl 3-mercaptopropionate, 8.0 parts by mass.

[Toner 3]

Toner 3 was produced as in toner 1, except that during preparation of the dispersion of amorphous vinyl resin particles, the mixture of monomers used in the third polymerization step was replaced with a mixture of monomers having the following composition:

styrene (St), 439.2 parts by mass;

2-ethylhexyl acrylate (2EHA), 78.8 parts by mass;

n-butyl acrylate, 80.0 parts by mass;

methacrylic acid (MAA), 52.0 parts by mass; and n-octyl 3-mercaptopropionate, 8.0 parts by mass.

[Toner 4]

Toner 4 was produced as in toner 1, except that during preparation of the dispersion of amorphous vinyl resin particles, the mixture of monomers used in the second polymerization step was replaced with a mixture of monomers having the following composition:

styrene (St), 302.4 parts by mass;

n-butyl acrylate (BA), 6.0 parts by mass;

2-ethylhexyl acrylate (2EHA), 71.6 parts by mass;

methacrylic acid (MAA), 20.0 parts by mass;
n-octyl 3-mercaptopropionate, 1.5 parts by mass; and
behenyl behenate (release agent, melting point of 73° C.), 190.0 parts by mass.

[Toner 5]

Toner 5 was produced as in toner 1, except that during preparation of the dispersion of amorphous vinyl resin particles, the mixture of monomers used in third polymerization step was replaced with a mixture of monomers having the following composition:
styrene (St), 361.8 parts by mass;
2-ethylhexyl methacrylate (2EHMA), 143.2 parts by mass;
n-butyl acrylate, 93.0 parts by mass;
methacrylic acid (MAA), 52.0 parts by mass; and
n-octyl 3-mercaptopropionate, 8.0 parts by mass.

[Toner 6]

Toner 6 was produced as in toner 1, except that during preparation of the dispersion of amorphous vinyl resin particles, the mixture of monomers used in the third polymerization step was replaced with a mixture of monomers having the following composition:
styrene (St), 425.8 parts by mass;
isononyl acrylate (INAA), 143.2 parts by mass;
n-butyl acrylate, 29.0 parts by mass;
methacrylic acid (MAA), 52.0 parts by mass; and
n-octyl 3-mercaptopropionate, 8.0 parts by mass.

[Toner 7]

Toner 7 was produced as in toner 1, except that during preparation of the dispersion of amorphous vinyl resin particles, the mixture of monomers used in the third polymerization step was replaced with a mixture of monomers having the following composition:
styrene (St), 425.8 parts by mass;
isostearyl acrylate (ISAA), 143.2 parts by mass;
n-butyl acrylate, 29.0 parts by mass;
methacrylic acid (MAA), 52.0 parts by mass; and
n-octyl 3-mercaptopropionate, 8.0 parts by mass.

[Toner 8]

Toner 8 was produced as in toner 1, except that during preparation of the dispersion of amorphous vinyl resin particles, the mixture of monomers used in the third polymerization step was replaced with a mixture of monomers having the following composition and the toner particles were formed without addition of the dispersion of amorphous polyester resin particles of the shell layer:
styrene (St), 467.1 parts by mass;
2-ethylhexyl acrylate (2EHA), 126.9 parts by mass;
n-butyl acrylate, 4.0 parts by mass;
methacrylic acid (MAA), 52.0 parts by mass; and
n-octyl 3-mercaptopropionate, 8.0 parts by mass.

[Toner 9]

Toner 9 was produced as in toner 1, except that during preparation of the dispersion of amorphous vinyl resin particles, the mixture of monomers used in the third polymerization step was replaced with a mixture of monomers having the following composition:
styrene (St), 428.9 parts by mass;
2-ethylhexyl acrylate (2EHA), 40.1 parts by mass;
n-butyl acrylate, 129.0 parts by mass;
methacrylic acid (MAA), 52.0 parts by mass; and
n-octyl 3-mercaptopropionate, 8.0 parts by mass.

[Toner 21]

Toner 21 was produced as in toner 1, except that during preparation of the dispersion of amorphous vinyl resin particles, the mixture of monomers used in the third polymerization step was replaced with a mixture of monomers having the following composition:
styrene (St), 420.0 parts by mass;
n-butyl acrylate, 178.0 parts by mass;
methacrylic acid (MAA), 52.0 parts by mass; and
n-octyl 3-mercaptopropionate, 8.0 parts by mass.

[Toner 22]

Toner 22 was produced as in toner 1, except that during preparation of the dispersion of amorphous vinyl resin particles, the mixture of monomers used in the third polymerization step was replaced with a mixture of monomers having the following composition:
styrene (St), 427.5 parts by mass;
2-ethylhexyl acrylate (2EHA), 31.5 parts by mass;
n-butyl acrylate, 139.0 parts by mass;
methacrylic acid (MAA), 52.0 parts by mass; and
n-octyl 3-mercaptopropionate, 8.0 parts by mass.

[Toner 23]

Toner 23 was produced as in toner 1, except that during preparation of the dispersion of amorphous vinyl resin particles, the mixture of monomers used in the third polymerization step was replaced with a mixture of monomers having the following composition:
styrene (St), 303.6 parts by mass;
2-ethylhexyl acrylate (2EHA), 286.4 parts by mass;
n-butyl acrylate, 8.0 parts by mass;
methacrylic acid (MAA), 52.0 parts by mass; and
n-octyl 3-mercaptopropionate, 8.0 parts by mass.

[Toner 24]

Toner 24 was produced as in toner 1, except that during preparation of the dispersion of amorphous vinyl resin particles, the mixture of monomers used in the third polymerization step was replaced with a mixture of monomers having the following composition:
styrene (St), 437.8 parts by mass;
n-octyl acrylate (NOAA), 143.2 parts by mass;
n-butyl acrylate, 17.0 parts by mass;
methacrylic acid (MAA), 52.0 parts by mass; and
n-octyl 3-mercaptopropionate, 8.0 parts by mass.

[Toner 25]

Toner 25 was produced as in toner 1, except that during preparation of the dispersion of amorphous vinyl resin particles, the mixture of monomers used in the third polymerization step was replaced with a mixture of monomers having the following composition:
styrene (St), 379.8 parts by mass;
isobutyl acrylate (IBAA), 143.2 parts by mass;
n-butyl acrylate, 75.0 parts by mass;
methacrylic acid (MAA), 52.0 parts by mass; and
n-octyl 3-mercaptopropionate, 8.0 parts by mass.

[Evaluation]

The fixing properties of the resulting toners 1 to 9 and 21 to 25 were evaluated as described below.

Samples were prepared for toners 1 to 9 and 21 to 25 stored under different conditions. Specifically, two samples were prepared for each of toners 1 to 9 and 21 to 25. One of the samples was stored under a storage condition A or an environment of normal temperature (20° C.) and normal humidity (relative humidity of 50% RH) for 24 hours. The other samples were stored under a storage condition B or an environment of high temperature (50° C.) and moderate humidity (relative humidity of 40% RH) for 24 hours.

Developers were prepared using the respective samples of toners 1 to 9 and 21 to 25 stored under the storage conditions A and B. Solid images were formed on sheets NPI (having a grammage of 128 g/m$^2$) (manufactured by Nippon Paper Industries Co., Ltd.) with the developers loaded in an image forming device under normal temperature (20° C.) and normal humidity (relative humidity of 50% RH). In the solid image, the density of the toner on the sheet was 11.3 g/m$^2$. The image forming device was a multifunctional device Bizhub Press C1070 (manufactured by Konica Minolta, Inc.). The developers were prepared by mixing a silicone-resin-coated ferrite carrier having a volume-based median diameter (d50) of 60 μm to each sample of toners 1 to 9 and 21 to 25.

The surface of one of the two rollers of the fixing device was heated to 100° C., and the surface temperature of the other roller was stepwise varied between 140° C. and 180° C. in 2° C. increments, to fix solid images to the sheets. The lowest temperature among the varied temperatures of the roller that did not result in under-offset was determined to be the lowest fixing temperature. The under-offset is an image defect in which the toner separates from a transfer material or sheet due to insufficient melting of the toner heated by the fixing device.

The fixing properties were evaluated in accordance with the following ranks based on the difference Δ (° C.) between the lowest fixing temperature of each sample of toners 1 to 9 and 21 to 25 stored under the storage condition A and that stored under the storage condition B. Toner evaluated as a rank 2 or higher was acceptable.

Rank 3: No difference in the lowest fixing temperatures, and no change in fixing properties Rank 2: A difference between the lowest fixing temperatures of higher than 0° C. and lower than or equal to 4° C., and a slight change in fixing properties Rank 1: A difference between the lowest fixing temperatures of more than 4° C., and a significant change in fixing properties Table 1 shows the results of the evaluation.

In Table 1, the content (mass %) of the crystalline polyester resin and the content of the amorphous polyester resin in the toner particles were respectively calculated from the amounts of the added resins.

The content (calculated value) of the monomers having a structure represented by formula (1) in Table 1 was the content (mass %) of the monomers in the toner particles calculated from the added amount of monomers. The content (measured value) (mass %) of the monomers in the toner particles were measured through GC/MS. The conditions of pyrolysis and GC/MS analysis were as follows:

(Conditions of Pyrolysis)

Device: PY-2020iD (Manufactured by Frontier Laboratories Ltd.)

Mass of sample: 0.1 mg

Heating temperature: 550° C.

Heating time: 0.5 minutes (Run Conditions of GC/MS)

Device: QP2010 (manufactured by Shimadzu Corporation)

Column: Ultra ALLOY-5 (inner circumference 0.25 mm; length 30 m; thickness 0.25 μm; manufactured by Frontier Laboratories Ltd.)

Heating range: 100° C. to 320° C. (maintained at 320° C.)

Heating rate: 20° C./min

TABLE 1

| | CORE PARTICLE | | | | | | |
|---|---|---|---|---|---|---|---|
| | CRYSTALLINE | AMORPHOUS VINYL RESIN | | | | | |
| | POLYESTER RESIN | MONOMERS HAVING | | $R_2$ | | CONTENT (CALCULATED | CONTENT (MEASURED |
| TONER No. | CONTENT [MASS %] | STRUCTURE OF FORMULA (1) | $R_1$ | ALKYL STRUCTURE | CARBON NUMBER | VALUE) [MASS %] | VALUE) [MASS %] |
| 1 | 10 | 2-ETHYLHEXYL ACRYLATE | H | BRANCHED | 8 | 9.0 | 8.9 |
| 2 | 10 | 2-ETHYLHEXYL ACRYLATE | H | BRANCHED | 8 | 4.1 | 4.0 |
| 3 | 10 | 2-ETHYLHEXYL ACRYLATE | H | BRANCHED | 8 | 5.0 | 4.9 |
| 4 | 10 | 2-ETHYLHEXYL ACRYLATE | H | BRANCHED | 8 | 13.5 | 18.8 |
| 5 | 10 | 2-ETHYLHEXYL METHACRYLATE | $CH_3$ | BRANCHED | 8 | 9.0 | 8.9 |
| 6 | 10 | ISONONYL ACRYLATE | H | BRANCHED | 9 | 9.0 | 8.8 |
| 7 | 10 | ISOSTEARYL ACRYLATE | H | BRANCHED | 18 | 9.0 | 8.9 |
| 8 | 10 | 2-ETHYLHEXYL ACRYLATE | H | BRANCHED | 8 | 9.0 | 8.9 |
| 9 | 10 | 3-ETHYLHEXYL ACRYLATE | H | BRANCHED | 8 | 2.5 | 2.4 |
| 21 | 10 | — | — | — | — | — | — |
| 22 | 10 | 2-ETHYLHEXYL ACRYLATE | H | BRANCHED | 8 | 2.0 | 1.9 |
| 23 | 10 | 2-ETHYLHEXYL ACRYLATE | H | BRANCHED | 8 | 18.0 | 17.7 |
| 24 | 10 | n-OCTYL ACRYLATE | H | LINEAR | 8 | 9.0 | 8.9 |
| 25 | 10 | ISOBUTYL ACRYLATE | H | BRANCHED | 4 | 9.0 | 8.8 |

TABLE 1-continued

| TONER No. | SHELL LAYER AMORPHOUS POLYESTER RESIN CONTENT [MASS %] | FIXING PROPERTIES TEMPERATURE DIFFERENCE Δ [° C.] | FIXING PROPERTIES EVAL-UATION | NOTE |
|---|---|---|---|---|
| 1 | 9 | 0 | 3 | PRESENT INVENTION |
| 2 | 9 | 2 | 2 | PRESENT INVENTION |
| 3 | 9 | 0 | 3 | PRESENT INVENTION |
| 4 | 9 | 0 | 3 | PRESENT INVENTION |
| 5 | 9 | 2 | 2 | PRESENT INVENTION |
| 6 | 9 | 2 | 2 | PRESENT INVENTION |
| 7 | 9 | 2 | 2 | PRESENT INVENTION |
| 8 | 0 | 4 | 2 | PRESENT INVENTION |
| 9 | 9 | 4 | 2 | PRESENT INVENTION |
| 21 | 9 | 8 | 1 | COMPARATIVE EXAMPLE |
| 22 | 9 | 6 | 1 | COMPARATIVE EXAMPLE |
| 23 | 9 | 6 | 1 | COMPARATIVE EXAMPLE |
| 24 | 9 | 6 | 1 | COMPARATIVE EXAMPLE |
| 25 | 9 | 8 | 1 | COMPARATIVE EXAMPLE |

With reference to Table 1, toners 1 to 9, which have branched alkyl groups having a carbon number of 8 or more in a repeated structural unit derived from monomers having a structure represented by formula (1) and contain amorphous vinyl resin having a content of structural units in the toner particles within the range of 2.4 to 13.5 mass %, maintain their original fixing properties, regardless of the storage conditions. In contrast, toners 21 to 25, which do not have an amorphous vinyl resin component or have an amorphous vinyl resin component that is too large or too small, do not maintain their original fixing properties, that is, the fixing properties significantly changed.

What is claimed is:

1. A toner for developing electrostatic images comprising toner particles, wherein the toner particles comprise a crystalline resin and an amorphous resin;

the toner particles have a core-shell structure having a core and a shell on the core, wherein the core comprises the crystalline resin and the amorphous resin;

the amorphous resin comprises an amorphous vinyl resin component comprising a polymer of monomers having a structure represented by formula (1); and the content of a structural unit derived from the monomers in the toner particles is within a range of 2.4 to 13.5 mass %:

$$H_2C{=}CR_1{-}COOR_2 \quad (1)$$

where $R_1$ represents a hydrogen atom or a methyl group and $R_2$ represents a branched alkyl group having a carbon number of 8 or more.

2. The toner for developing electrostatic images according to claim 1, wherein the content of the structural unit derived from the monomers in the toner particles is within a range of 4.0 to 13.5 mass %.

3. The toner for developing electrostatic images according to claim 1, wherein the content of the structural unit derived from the monomers in the toner particles is within a range of 4.9 to 13.5 mass %.

4. The toner for developing electrostatic images according to claim 1, wherein the carbon number of the branched alkyl group represented by $R_2$ in formula (1) is 22 or less.

5. The toner for developing electrostatic images according to claim 1, wherein the carbon number of the branched alkyl group represented by $R_2$ in formula (1) is 8.

6. The toner for developing electrostatic images according to claim 1, wherein the content of the crystalline resin in the toner particles is within a range of 1 to 20 mass %.

7. The toner for developing electrostatic images according to claim 1, wherein the crystalline resin comprises a crystalline polyester resin component.

8. The toner for developing electrostatic images according to claim 1, wherein the amorphous resin further comprises an amorphous polyester resin component.

9. The toner for developing electrostatic images according to claim 8, wherein the amorphous polyester resin component comprises a hybrid resin modified with a styrene acrylic resin component.

10. The toner for developing electrostatic images according to claim 9, wherein the content of segments of the styrene acrylic resin component in the hybrid resin is within a range of 1 to 30 mass %.

11. The toner for developing electrostatic images according to claim 1, wherein, the toner particles comprise silica particles, and the average primary particle diameter of the silica particles is within a range of 70 to 200 nm.

12. A method of producing the toner for developing electrostatic images according to claim 1, comprising:

mixing a dispersion of crystalline resin particles in an aqueous medium and a dispersion of amorphous resin particles in an aqueous medium with a dispersion of colorant particles in an aqueous medium; and agglomerating and fusing the crystalline resin particles, the amorphous resin particles, and the colorant particles in the mixed aqueous media, to produce the toner particles.

13. The toner for developing electrostatic images according to claim 1, wherein the shell comprises an amorphous polyester resin.

* * * * *